US010090596B2

(12) United States Patent
Daniels et al.

(10) Patent No.: US 10,090,596 B2
(45) Date of Patent: Oct. 2, 2018

(54) ROBUST ANTENNA CONFIGURATIONS FOR WIRELESS CONNECTIVITY OF SMART HOME DEVICES

(71) Applicant: Google LLC, Mountain View, CA (US)

(72) Inventors: Eric Daniels, San Francisco, CA (US); Daniel Adam Warren, San Francisco, CA (US); Hirofumi Honjo, Palo Alto, CA (US)

(73) Assignee: Google LLC, Mountain View, CA (US)

( * ) Notice: Subject to any disclaimer, the term of this patent is extended or adjusted under 35 U.S.C. 154(b) by 537 days.

(21) Appl. No.: 14/328,476

(22) Filed: Jul. 10, 2014

(65) Prior Publication Data

US 2016/0013560 A1 Jan. 14, 2016

(51) Int. Cl.
*H01Q 9/42* (2006.01)
*H01Q 1/24* (2006.01)

(52) U.S. Cl.
CPC ..... *H01Q 9/42* (2013.01); *H01Q 1/243* (2013.01)

(58) Field of Classification Search
CPC ..... H01Q 9/42; H01Q 1/243
USPC ..... 343/700 MS
See application file for complete search history.

(56) References Cited

U.S. PATENT DOCUMENTS 5,177,324 A * 1/1993 Carr ..... H05K 1/0218 174/250
6,850,200 B2 * 2/2005 Tracy ..... H01Q 9/0421 343/700 MS
6,985,108 B2 * 1/2006 Mikkola ..... H01Q 1/243 343/700 MS
6,992,627 B1 * 1/2006 Honda ..... H01Q 1/243 343/700 MS
7,265,724 B1 * 9/2007 Tan ..... H01Q 1/243 343/700 MS
8,742,992 B2 * 6/2014 Kai ..... H01Q 1/243 343/700 MS
8,743,011 B2 * 6/2014 Kim ..... H01Q 1/243 343/845
2004/0085244 A1 * 5/2004 Kadambi ..... H01Q 9/0421 343/700 MS
2004/0196190 A1 * 10/2004 Mendolia ..... H01Q 1/085 343/700 MS
2005/0024270 A1 * 2/2005 Zheng ..... H01Q 1/243 343/702
2007/0008221 A1 * 1/2007 Tseng ..... H01Q 1/2216 343/700 MS (Continued)

*Primary Examiner* — Dameon E Levi
*Assistant Examiner* — David Lotter
(74) *Attorney, Agent, or Firm* — Kilpatrick Townsend & Stockton LLP

(57) ABSTRACT

Various methods related to antennas and embodiments of antennas are presented. The antenna may include an upper arm, wherein the upper arm is substantially parallel to a ground plane and is electrically coupled with at least a ground shorting structure, a support structure, and a feed structure. The antenna may include the ground shorting structure, which may be at a first end of the upper arm. The antenna may include the support structure, which may be at a second end of the length of the upper arm and may support the upper arm. The antenna may also include the feed structure, which is configured to provide a signal for wireless transmission, the feed structure may be attached to a side of the length of the upper arm.

25 Claims, 8 Drawing Sheets

(56) References Cited

U.S. PATENT DOCUMENTS

| | | | | |
|---|---|---|---|---|
| 2007/0096988 | A1* | 5/2007 | Parsche | H01Q 1/38 343/700 MS |
| 2014/0354486 | A1* | 12/2014 | Flores-Cuadras | H01Q 1/38 343/700 MS |

* cited by examiner

ROBUST ANTENNA CONFIGURATIONS FOR WIRELESS CONNECTIVITY OF SMART HOME DEVICES

BACKGROUND

Surface mount technology (SMT) allows for components to be placed onto a printed circuit board (PCB), using techniques such as pick-and-place. A pick-and-place machine may use suction or some other technique to pick up a component, move it to the appropriate location on the circuit board, and place the component for mounting, such as by using solder, on the PCB.

Use of a pick-and-place machine to mount SMT components on a PCB and/or manual handling may occasionally damage SMT components, especially components that are structurally weak. For instance, referring generally to antennas, an antenna attached to a PCB by a pick-and-place machine may be bent or mounted at an angle (along any axis) off of the desired mounting orientation. Such bending or displaced mounting can result in decreased performance of the SMT component, especially in the case of antennas.

SUMMARY

A planar inverted-F antenna (PIFA) is described that provides structural support to decrease the chance of bending or displacement during manufacturing, such as being attached to a circuit board by a pick-and-place machine and/or during manual handling. Such a PIFA may have a support structure attached to the PIFA's upper arm. The support structure may be used to provide support against bending of the PIFA's upper arm. Further, in addition or in alternate, one or more longitudinal structures may be attached to the PIFA's upper arm to provide structural support to the PIFA. For a PIFA to function properly, a ground plane may be in a roughly parallel plane with the PIFA's upper arm. By using a lower layer of the circuit board as the ground plane, the mounting height of the PIFA above the surface of the circuit board may be decreased.

Various devices, methods, apparatuses, and other arrangements related to antennas are presented herein. Such antennas may have an upper arm, wherein the upper arm has a length, the upper arm is substantially parallel to a ground plane, and is electrically coupled with at least a ground shorting structure, a support structure, and a feed structure. The ground shorting structure may be configured to electrically couple the upper arm to the ground plane. The ground shorting structure may be at a first end of the length of the upper arm and may be perpendicular to the upper arm. The support structure may be configured to be mounted to a circuit board. The support structure may be at a second end of the length of the upper arm and may be perpendicular to the upper arm. The feed structure, may be configured to electrically couple a signal involved in wireless transmission, the feed structure attached to a side of the length of the upper arm that is perpendicular to the first and second ends, the feed structure may also be perpendicular to the upper arm.

In some embodiments, the antenna may include an upper means, wherein the upper means has a length, the upper means may be substantially parallel to a ground plane, and may be electrically coupled with at least a ground shorting means, a support means, and a feed means. The ground shorting means may be configured to electrically couple the upper means to a ground plane. The ground shorting means may be at a first end of the length of the upper means. The support means may be configured to be mounted to a circuit board. The support means may be at a second end of the length of the upper means. The feed means may be configured to electrically couple a signal involved in wireless transmission, the feed structure attached to a side of the length of the upper arm.

Such an antenna apparatus may include one or more of the following features. The antenna may be configured to be surface mounted to the circuit board. The support means may be configured to be surface mounted to a surface of the circuit board proximate to the upper means. The antenna may be a planar inverted-f antenna. The upper means may further include at least one longitudinal support means, wherein the at least one longitudinal support means extends along at least a portion of the length of the upper means. The upper means may be configured to decrease interference with airflow over the surface of the upper means farthest from the ground plane. The upper means, the ground shorting means, the support means, and the feed structure means may be a single piece of metal folded to form the antenna. The ground shorting means may be electrically coupled with a layer of the circuit board farthest from the upper means, wherein at least a portion of the layer serves as the ground plane. The feed structure means and the ground shorting means may be configured to be through-hole mounted to the circuit board. The upper means may have a width that is at least twice as wide as the width of the support means. The apparatus may include a solder mounting means on the circuit board for the support structure, wherein the solder mounting pad comprises: solder means to mount the support means to the circuit board; and solder mask means that overlaps the entire surface edge of the metallic solder.

DETAILED DESCRIPTION

A planar inverted-f antenna (PIFA) is a form of a monopole antenna. On a conventional PIFA, an upper arm is present. A first end of the upper arm is mounted to a signal feed and ground. The second end of the upper arm, however, is free of any supporting structure. Therefore, this second end of the upper arm is prone to being inadvertently bent or mounted at an angle displaced from the desired orientation while being attached to a PCB. When placed properly and not bent, such a PIFA may provide near optimal radiation characteristics. However, such a PIFA may not be conducive to being used in conjunction with pick-and-place machines due to a percentage of PIFAs being bent or placed at an unacceptable orientation during the manufacturing process. That is, such a PIFA may, at least occasionally, be bent or placed at an angle on a PCB during the mounting process. Whether the PIFA is bent, placed at an angle, or both, the radiation and/or sensitivity characteristics of the antenna may be negatively affected. For instance, if the PIFA is bent or displaced, the system in which the PIFA is installed may be unable to wirelessly communicate with a remote device and/or receive wireless signals. Such a problem with a PIFA could effectively render the device useless.

A structurally-supported PIFA can improve the ability of the PIFA to be surface mounted to a PCB. More specifically, a pick-and-place machine may be used to place the PIFA on a PCB for mounting with a decreased chance that the PIFA will be bent, placed at an angle off of the desired orientation, or both during the manufacturing process of attaching the PIFA to the PCB. Further, a structurally-supported PIFA will decrease the chance of bending during manual handling or various other forms of handling of the PIFA.

Figure 1:
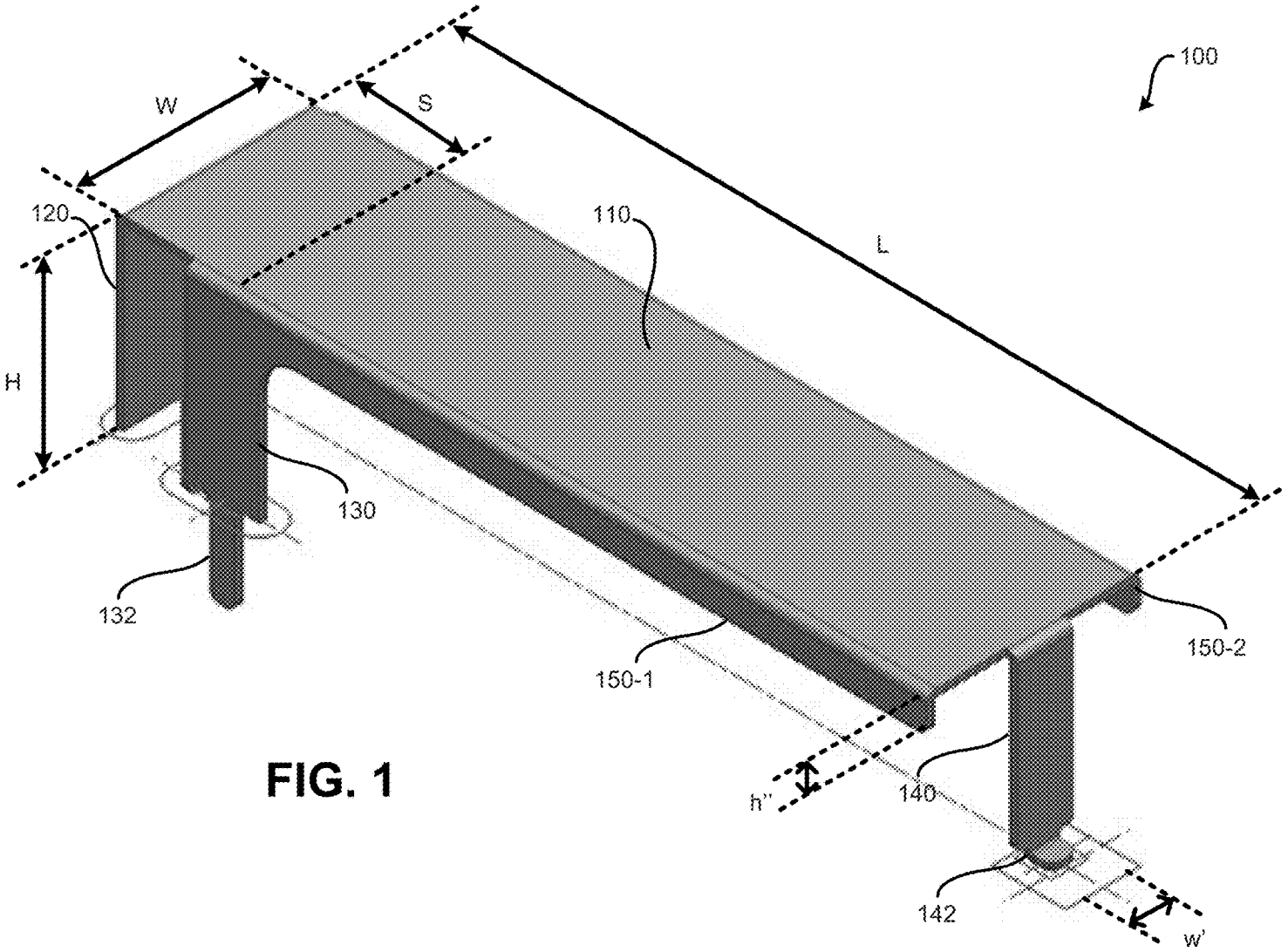
FIG. 1 illustrates an embodiment of a stabilized planar inverted-f antenna (PIFA).

FIG. 1 illustrates an embodiment of a stabilized planar inverted-f antenna (PIFA) 100. Embodiments of PIFA 100 can include: upper arm 110, ground shorting structure 120, feed structure 130, support structure 140, and longitudinal support structures 150 (150-1 and 150-2). Each of these components may be formed from a single piece of conductive material, such as metal. For instance, a flattened shape may be stamped or otherwise formed from a sheet of metal, then bent to form PIFA 100, which would remain a single piece of metal.

Upper arm 110 of PIFA 100 may be electrically and mechanically connected to at least three structures, including ground shorting structure 120, feed structure 130, and support structure 140. Upper arm 110 may have a length of L and a width of W, as illustrated in FIG. 1. In some embodiments, W is 5.7 mm and L is between 22-23 mm. In various other embodiments, W may range between 3-8 mm and L may range between 15-30 mm. Other dimensions are also possible, such as based on the desired operating frequency range of the PIFA. Ground shorting structure 120 may be at a first end of the length L of upper arm 110 while support structure 140 is at the second end of length L of upper arm 110, the second end being opposite the first end. Connected to a side of upper arm 110, such as a side perpendicular and between support structure 140 and ground shorting structure 120, may be feed structure 130. In various points throughout this document, "perpendicular" is used to describe a 90 degree angle between two components. It should be understood that perpendicular can also refer to an approximate 90 degree angle, such as between 80 and 100 degree angles. For more optimal radiation and reception characteristics, upper arm 110 of PIFA 100 may be parallel or nearly parallel to a ground plane (not shown). In some embodiments, it may be possible to use an external metal structure as a ground plane, such as a frame or enclosure to which the PCB on which PIFA 100 is present is mounted, or even a structure on which the device incorporating PIFA 100 is mounted. In some embodiments, the ground plane may be incorporated into the PCB. In such embodiments, the ground plane may be present in at least a portion of a layer of the PCB on which PIFA 100 is mounted. In some embodiments, a top layer of the PCB may be used. In other embodiments, a lower layer may be used. Use of a lower layer of the PCB may allow upper arm 110 to be mounted closer to the PCB while still maintaining a desired height H, which represents the distance between upper arm 110 and the ground plane. In the illustrated embodiment of PIFA 100 of FIG. 1, it is assumed that the top layer of the PCB is the ground plane for height H. In some embodiments, H is 5 mm. In various other embodiments, H may range between 2-8 mm. Other dimensions are also possible, such as based on the desired operating frequency range of the PIFA. The height H can more clearly be viewed in FIG. 4, which represents a lower layer of the PCB being used as the ground plane. Mounting the upper arm close to the PCB may result in a more structurally sound PIFA and improved airflow over the top of upper arm 110, which may be important for applications such as those used in smoke or carbon monoxide detectors that rely on airflow reaching one or more sensors mounted on or near the PCB. It can be expected that, during installation by a pick-and-place machine on a PCB, PIFA 100 may be picked up near the middle of upper arm 110 and placed on the PCB with at least some pressure being exerted on this point on upper arm 110. Also, during manual handling, pressure may be applied to one or more various locations on upper arm 110.

At a first end of length L of upper arm 110, ground shorting structure 120 may be present. Ground shorting structure 120 may serve dual purposes: support of upper arm 110 and also to connect upper arm 110 with ground. In some embodiments, ground shorting structure 120 is a through-hole design that allows a portion of ground shorting structure 120 to pass through the PCB on which it is mounted. The through-hole portion of ground shorting structure 120 may be 1.6 mm in width and may be 2.4 mm in height. In various other embodiments, the through-hole portion of ground shorting structure 120 may range between 1-3 mm in width and 1-4 mm in height. Other dimensions are also possible. Such a through-hole design may permit surface mounting to be performed. In other embodiments, ground shorting structure 120 is mounted to only the surface of the PCB. If surface mounted, a foot may be incorporated as part of ground shorting structure 120 to facilitate attachment to the surface of a PCB. The center of ground shorting structure 120 may be a distance S from feed structure 130. In some embodiments, distance S may be 3.15 mm. In various other embodiments, S may range between 2-5 mm. As those with familiarity with conventional IFAs will understand, the value of L, H, W, and S affect the operating characteristics of the PIFA.

At a second end of length L of upper arm 110, support structure 140 may be present. Support structure 140 may be configured to keep any negative impact on radiation characteristics of PIFA 100 low while providing sufficient support to reduce bending or displacement during mounting of PIFA 100 to a PCB. While use of a metallic support structure may slightly affect the antenna's sensitivity, forming the entire PIFA from a single piece of material (e.g., metal) may simplify the manufacturing process. Therefore, the ability to cheaply manufacture a PIFA that can withstand the manufacturing and mounting process may outweigh a slight decrease in performance. Support structure 140 may be of a width w' which is less than W. In some embodiments, w' is less than 50% of W. In some embodiments, W is 5.7 mm and w' is 0.75 mm Support structure 140 may include support foot 142. Support foot 142 may be configured to be surface mounted via surface mount technology (SMT) to a PCB. Support foot 142 may provide a surface area to be attached to the surface of a PCB via solder or another attachment means. In some embodiments, support foot 142 may extend approximately 0.75 mm away from support structure 140. In other embodiments, support foot 142 may extend between 0.4 mm and 1 mm away from support structure 140. Other distances are also possible. In some embodiments, support foot 142 protrudes away from ground shorting structure 120; in other embodiments, support foot 142 protrudes toward ground shorting structure 120. In other embodiments, support foot 142 may protrude in another or multiple directions. The size of support foot 142 may be configured to provide sufficient contact with an underlying pad on the PCB for mounting, while minimizing the effect of the performance of PIFA 100. In various other embodiments, support structure 140 may be of a through-hole design, thus configured to pass through a hole in a PCB.

In some embodiments, support structure 140 is centered in width W of upper arm 110. Such centering may provide improved structural performance, such as for during pick-and-place mounting by a pick-and-place machine. In other embodiments, support structure 140 may be offset along the end of upper arm 110 opposite ground shorting structure 120.

Feed structure 130 may receive a signal to be transmitted via PIFA 100 (and/or output a signal received via PIFA 100). Feed structure 130 may serve dual purposes: support of upper arm 110 and also to connect upper arm 110 with a signal source or signal receiver. In some embodiments, feed structure 130 is a through-hole design that allows a portion of feed structure 130 to pass through the PCB on which it is mounted. The portion of feed structure 130 that passes through the PCB, which may be 2.4 mm in height and 0.7 mm in width, referred to as through-hole feed structure 132, may be of a lesser width than the portion of feed structure 130 that is above the PCB. Such dimensions of feed structure 130 may vary, such as between 2-3 mm in height and 0.4-1 mm in width. If surface mounted, a foot (such as foot 142) may be incorporated as part of feed structure 130 to facilitate SMT attachment to the surface of a PCB.

PIFA 100 may include one or more longitudinal support structures 150. In the illustrated embodiments, two longitudinal support structures 150 are present: longitudinal support structure 150-1 and longitudinal support structure 150-2. Longitudinal support structures 150 may be of a height h". In some embodiments, h" may be 1 mm. In other embodiments, h" may range from 0.5 mm-3 mm. Other dimensions are also possible. Each of longitudinal support structures 150 (150-1 and 150-2) may be at least approximately perpendicular to upper arm 110. Such longitudinal support structures 150 may decrease the likelihood of PIFA 100 being bent during installation on a PCB by a pick-and-place machine or other means of placing PIFA 100 on a PCB (e.g., manually being placed). Such structures may also prevent bending when PIFA 100 is otherwise being manipulated, such as manually handled. In some embodiments, rather than being perpendicular or approximately perpendicular, longitudinal support structures 150 may be at an angle to upper arm 110, such as 45 degrees or some other greater or smaller angle. In some embodiments such as those illustrated in FIG. 1, support structure 150-1 may be continuously coupled to and flush with feed structure 130. However, in other embodiments, one or more of support structures 150-1 and 150-2 may be at different angles than feed structure 130 with respect to upper arm 110, and may not be continuously coupled to or flush with feed structure 130.

In some embodiments, one or more longitudinal support structures 150 may run the full length L of upper arm 110. For instance, in PIFA 100, longitudinal support structure 150-2 extends the full length L or nearly the full length L of upper arm 110. Additionally or alternatively, one or more longitudinal support structures 150 may only be present along a portion of length L of upper arm 110. For example, in FIG. 1, longitudinal support structure 150-1 extends from the second end of upper arm 110 near support structure 140 to feed structure 130. Between feed structure 130 and ground shorting structure 120, at least along the side of upper arm 110 having feed structure 130, no longitudinal support structure may be present. In other embodiments, however, a longitudinal support structure may be present there.

Figure 2:
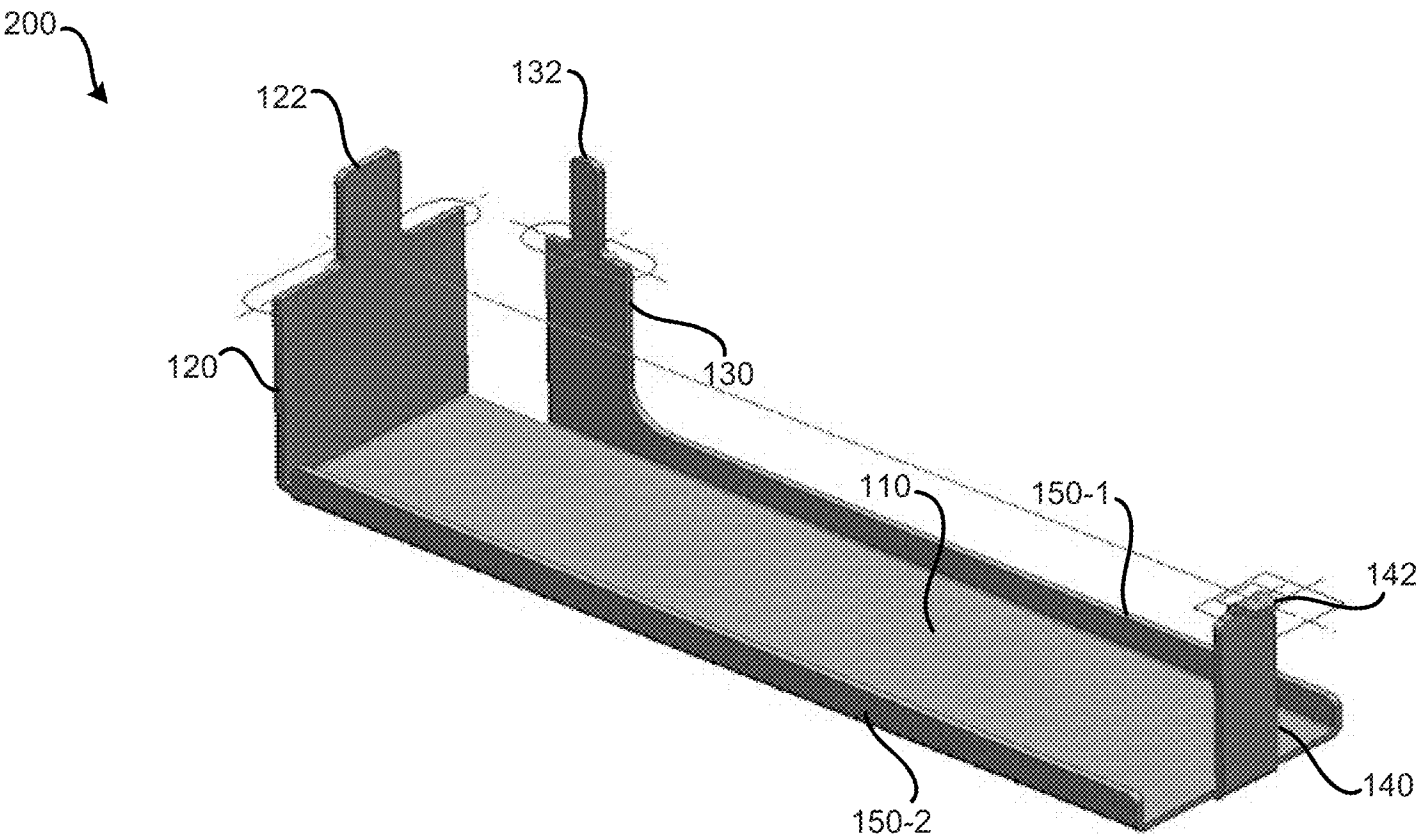
FIG. 2 illustrates another view of an embodiment of a stabilized planar inverted-f antenna.

FIG. 2 illustrates another view of an embodiment of a stabilized PIFA 200. PIFA 200 may represent PIFA 100 of FIG. 1 viewed from another angle. Visible in FIG. 2 is the portion of ground shorting structure 120 that passes through the PCB, referred to as through-hole ground shorting structure 122, which may be of a lesser width (or the same width or a greater width) than the portion of ground shorting structure 120 that is configured to be mounted above the surface of the PCB. In other embodiments, ground shorting structure 120 may be configured as a surface mount, possibly having a foot (similar to foot 142) for attachment to a metallic pad on the surface of a PCB. As can be seen in FIG. 2, ground shorting structure 120 extends the full or nearly the full width of upper arm 110. Through-hole ground shorting structure 122 may be wider than through-hole feed structure 132, or visa versa.

Figure 3A:
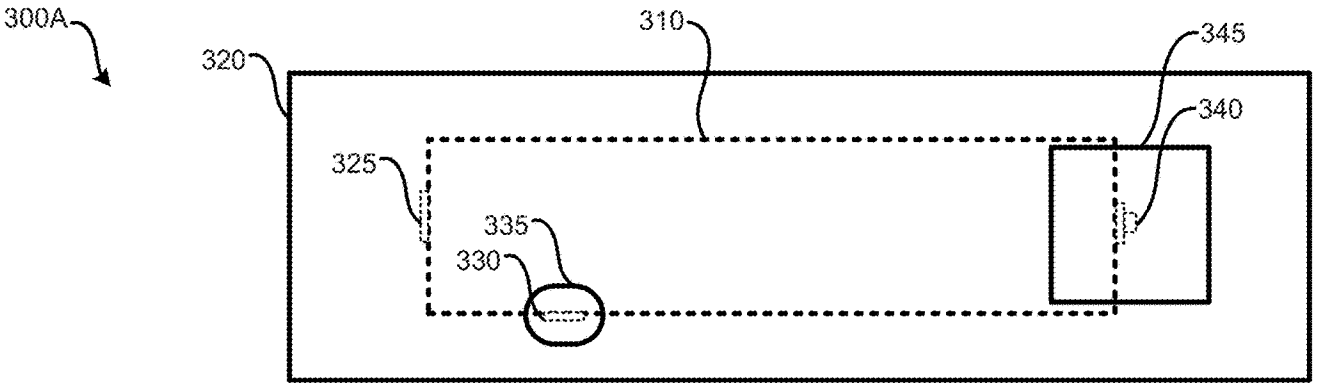
FIG. 3A illustrates an embodiment of a PCB layout in the region of a stabilized planar inverted-f antenna.

FIG. 3A illustrates an embodiment of a PCB layout 300A in the region of a stabilized planar inverted-f antenna. The outline of a PIFA as viewed from above, such as PIFA 100, is represented by PIFA 310 as a dotted box. For a PIFA to function effectively, a ground plane may need to be in a plane approximately parallel with the plane of the PIFA's upper arm. Unless otherwise noted, ground plane 320 may be present on the PCB within at least one layer of the PCB. In other embodiments, a ground plane located off of the PCB (but parallel to the PCB) may be used. In some embodiments, the top layer of the PCB may be formed as the ground plane. Additionally or alternatively, a lower layer of the PCB may be used. In other embodiments, all layers of the PCB may be formed as the ground plane. It should be appreciated that only a portion of the PCB may be formed as the ground plane. For example, the portion of the PCB forming the ground plane may have a footprint the same as that of the PIFA 100 or larger (e.g., 1% to 300% larger). Accordingly, while a ground plane may be formed in a portion of the PCB opposite the PIFA, other portions of the PCB may be used for other purposes, such as providing conductive traces. Further, since the distance between the upper arm and the ground plane, represented as height H in FIG. 4, can affect the radiation pattern of the PIFA, the use of a lower plane of the PCB for the ground plane may decrease the height to which the PIFA extends above the PCB. While FIG. 3A depicts ground plane 320 as extending beyond the footprint of PIFA 310, in some embodiments ground plane 320 may only be directly below PIFA 310, in some or all dimensions. The location of ground shorting structure 120 is represented by ground structure 325. Ground structure 325 may be connected to ground plane 320.

In some embodiments, one or more 'keep-out' regions may be incorporated into the PCB. A keep-out region defines a region in which conductive material, such as PCB traces, ground planes, etc., may be excluded from being on one or more (e.g., all) PCB layers. Such keep-out regions may be incorporated in one or more portions of the PCB, such as proximate ground structure 325, feed structure 330, and/or support structure 340. In some embodiments, no keep-out region may be necessary for ground structure 325 if ground structure 325 is connected with ground plane 320 which is the layer of the PCB closest to PIFA 310. In some embodiments, if layers of the PCB are present above the ground plane (closer to PIFA 310), a keep-out region may be defined around ground structure 325. Such a keep-out region may have a variety of dimensions, such as 6 mm by 1.2 mm. Other dimensions are also possible, such as between 2-10 mm by 0.5-3 mm. In some embodiments, the PCB may have a hole for a portion of ground shorting structure to pass through the PCB.

Within ground plane 320, certain regions may be excluded from being tied to ground. Region 335 may not be grounded, such that ground is maintained at least a distance away from feed structure 130 and through-hole feed structure 132. Region 335 may be understood as a keep-out region that may only be present on the ground plane (as opposed to multiple PCB layers that would otherwise contain signal traces and/or one or more ground planes). In some embodiments, region 335 is 3 mm by 1.2 mm, and may have a circular, square, rectangular, oval, or other shape. Within region 335, all conductive materials (except a trace connecting feed structure 330 to a transmitter or receiver) may be excluded to limit interference. Support structure 340, which includes a support foot (e.g., support foot 142), may not be electrically connected with ground. Keep-out region 345 may keep the ground (and, possibly, other signal traces) at least a minimum distance away from the support structure. Even though support structure 340 may be surface mounted, it may be desirable to not have the ground plane extend under support structure 340 in embodiments in which a layer of the PCB is used as the ground plane. As such, keep-out region 345 may be enforced through all layers of the PCB such that ground and/or any other signal is maintained a minimum distance away from support structure 340. In some embodiments, keep-out region 345 may extend through the PCB and any ground plane. In other embodiments, keep-out region 345 may extend through the PCB but not a ground plane provided on the bottom layer of the PCB. In yet other embodiments, keep-out region 345 may extend only partially through the PCB. If support structure 340 was not present, it may be more effective (e.g., for the radiation pattern) to have a ground plane fully present beneath the upper arm of PIFA 310. However, with support structure 340 present, having a portion of keep-out region 345 beneath the upper arm of PIFA 310 at a location where the support structure 340 exists may be preferable for an effective radiation pattern to having the ground plane extend closer to support structure 340. As mentioned, the keep-out region 345 may exclude signal traces and/or other conductive materials in the PCB, and in some embodiments may also exclude a ground plane.

While keep-out region 345 is illustrated as a square and region 335 is an ovaloid, it should be understood that various shapes of the regions can be used as keep-out regions for the ground plane and/or other signals that may cause interference or otherwise degrade performance of the PIFA, such as squares, rectangles, pentagons, octagons, ovals, etc.

Figure 3B:
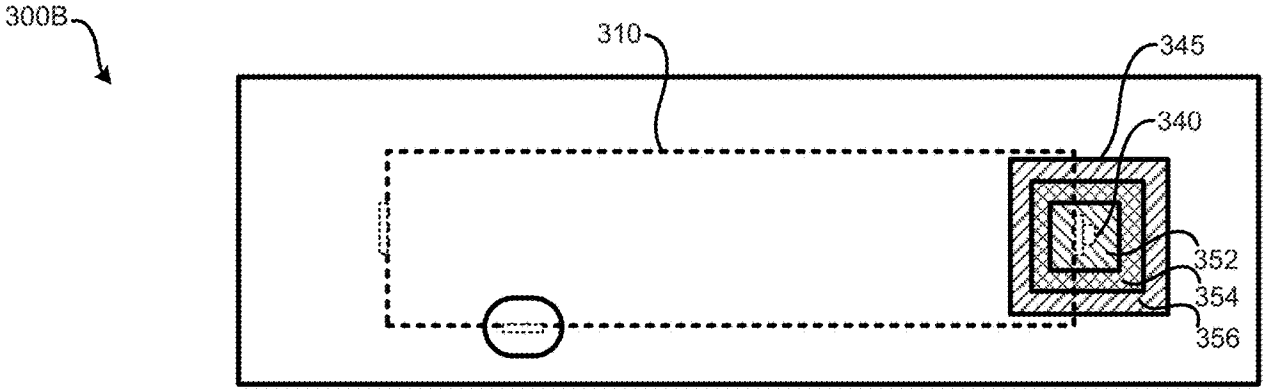
FIG. 3B illustrates an embodiment of a PCB layout in the region of a stabilized planar inverted-f antenna having solder mask overlap a solder pad of the antenna's support structure.

FIG. 3B illustrates an embodiment of a PCB layout 300B in the region of a stabilized planar inverted-f antenna having solder mask (resist) overlapping a metallic pad to be attached with the antenna's support structure. To anchor PIFA 310 to the PCB, it may be beneficial to ensure a strong bond is present between the PCB and support structure 340. One or more metal pads on the PCB present on the surface of the PCB in regions 354 and 352 may be bonded with support structure 340 (possibly including a support foot) via solder. In some embodiments, region 352 is approximately 1 mm by 1 mm. Other dimensions are also possible, such as between 0.5 mm by 0.5 mm to 3 mm by 3 mm. To strengthen the bond between the pad, the PCB, and the support structure, a portion of the metal pad may be covered with solder mask. This may decrease the chance that the pad will disconnect from the PCB due to a force, such as torque applied to the pad via the PIFA, such as during the manufacturing process. Regions 356 and 354, but excluding region 352, may be covered in solder mask (overlapping any portion of a metal pad present). Therefore, an overlap region exists as defined by region 354 in which at least a portion of the edge of a metallic pad on the PCB is beneath a solder mask. The entire surface portion of keep-out region 345 may be covered in solder mask. However, the metal pad may not be present in region 356 outside of region 354. It should be understood that, in various embodiments, solder mask may extend significantly beyond the boundaries of keep-out region 345.

Figure 4:
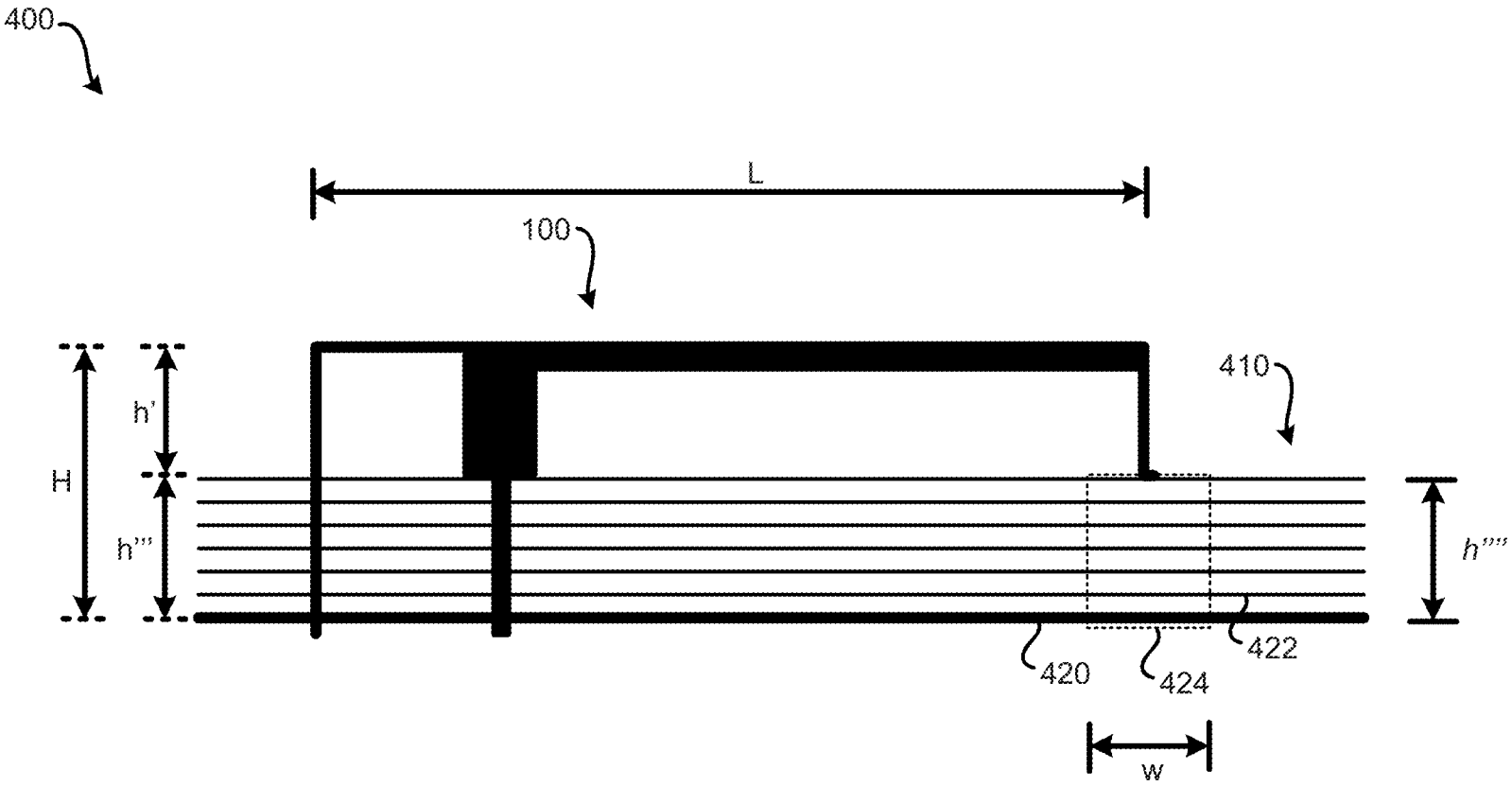
FIG. 4 illustrates a side view of an embodiment of a stabilized planar inverted-f antenna in which a lower layer of the PCB is used as the ground plane.

FIG. 4 illustrates a side view of an embodiment 400 of a stabilized planar inverted-f antenna in which a lower layer of the PCB is used as the ground plane. In embodiment 400, PIFA 100 is installed on PCB 410. While the ground shorting structure and feed structure may pass through multiple layers, one or more keep-out regions may be present to prevent such components from being electrically connected (e.g., magnetically coupled) with traces carrying signals or other sources of interference (power, ground) present on such layers. For instance, the ground shorting structure may be electrically connected with ground on plane 420 but not connected to any traces on the other layers of PCB 410. Also, a keep-out region may be present around the support structure on one or more layers of PCB 410.

It may be desirable to minimize h' in some circumstances. The height h' represents the height which PIFA 100 extends above the top surface of PCB 410. It may be desired to minimize the magnitude of h' for several reasons, including stability (that is, the shorter the distance above PCB 410, the more stable and secure PIFA 100 may be to the PCB) and airflow. Regarding airflow, possible uses for PIFA 100 include use on PCBs in devices that detect smoke and/or carbon monoxide. If a sensor on PCB 410 or in the vicinity of PCB 410 relies on airflow to receive the smoke and/or carbon monoxide (or some other airborne gas or particulate), allowing for improved airflow over the surface of PCB 410 may be desirable. Further, such airflow may allow for reliable long-term operability of connected smart home devices (e.g., via better heat dissipation).

By using either the lowest (PCB layer 420) or a lower layer of PCB 410 as the ground plane, h' can be decreased while having an H (which is the distance between the ground plane and the upper arm of PIFA 100) that allows for acceptable radiation characteristics of PIFA 100. The value of H may affect the radiation (and/or reception) characteristics of PIFA 100. Therefore, by using the lowest layer of PCB 410, which is PCB layer 420, as the ground plane, h' can be decreased while maintaining an acceptable H. Due to different dielectric properties between air for height h' and the printed circuit board for height h'", the height H will vary depending on which layer of the PCB is used for ground. If a lower layer of PCB 410 is used as the ground plane, it may be desirable to have no traces pass on PCB 410 between the upper arm of PIFA 100 and the PCB layer 420 which is functioning as the ground plane to improve the efficiency of PIFA 100. Further, a keep-out region 424 may be defined on these layers beneath the upper arm of PIFA 100. The keep-out region 424 may have any suitable width (w), height (h""), and depth (perpendicular to the width and height). In this particular example, the width (w) is approximately three times the width of the foot of the support structure, but in other embodiments the width (w) could be other multiples or multiple fractions with respect to the size of the foot of the support structure. The height (h"") in this example extends entirely between the bottom surface of the foot and through ground plane 420, but in other embodiments the height (h"") could be less (e.g., from the bottom surface of the foot to a distance a quarter way, half way, or three quarters to the ground plane 420, or in a range somewhere therebetween). In other embodiments, the keep-out region 424 may extend from (and include) the ground plane 420 toward the foot of the support structure. In yet other embodiments, the keep-out region 424 may be located between the foot of the support structure and the ground plane 420, where at least one conductive area exists between the keep-out region 424 and the foot of the support structure and/or the keep-out region 424 and the ground plane 420.

While the embodiments described with reference to FIG. 4 include a PCB 410 that has layers which exclude conductive materials and include a ground plane formed on a bottom layer such as PCB layer 422, in other embodiments one or more other layers of PCB 410 may also be formed as a ground plane, such as PCB layer 422. In such cases, it should be appreciated that the keep-out region 424 may extend through some or all of those ground planes. For example, in one embodiment, all of the layers of PCB 410, including layers 420 and 422, may be formed as a ground plane. The keep-out region 424 in one embodiment may then extend through all of these layers in a region proximate the support foot. It should be appreciated that if PCB layers are present below a layer used as the ground plane, such layers may have traces pass under the upper arm of PIFA 100 without significantly adversely affecting the performance of PIFA 100.

Figure 5:
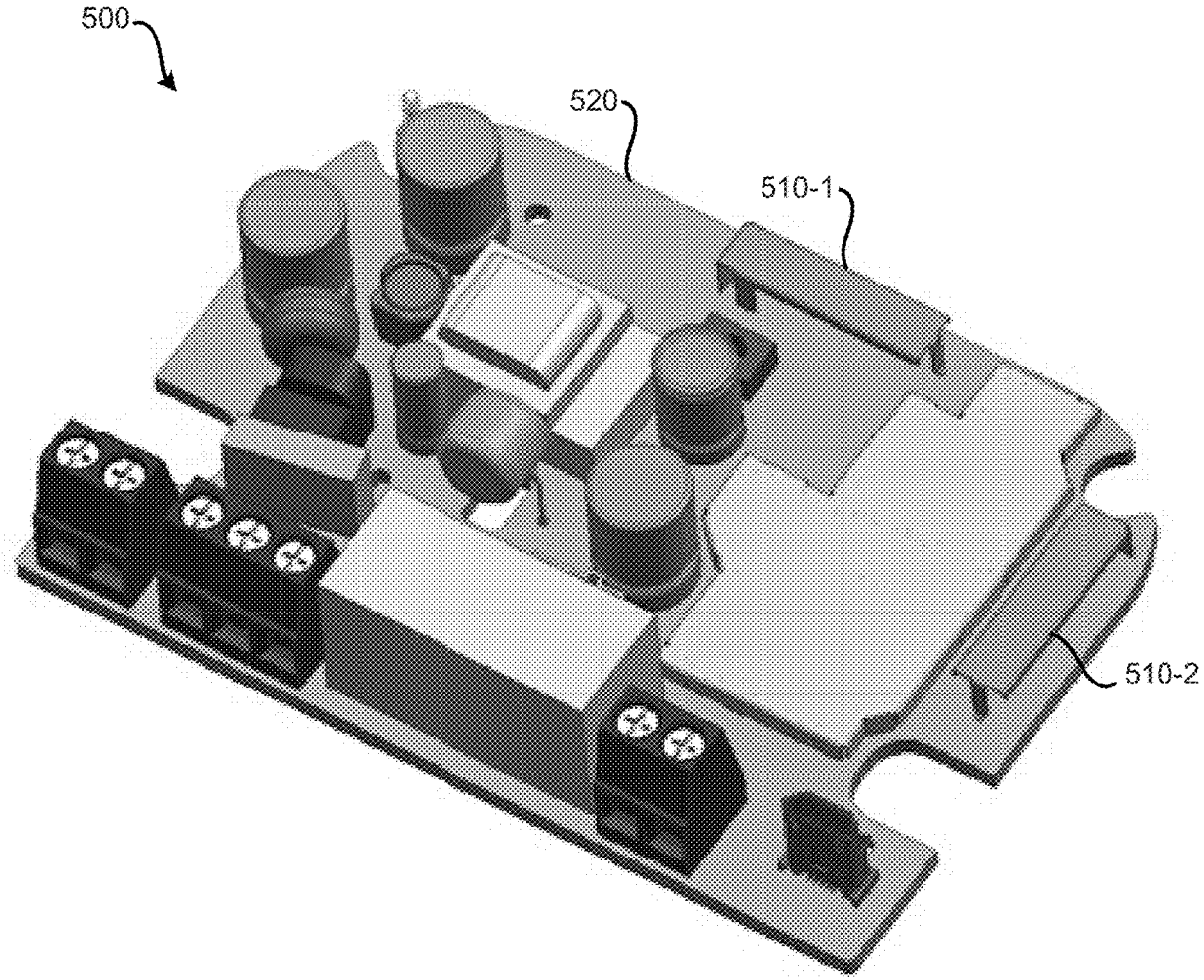
FIG. 5 illustrates an embodiment of a circuit board having two mounted instances of planar inverted-f antennas.

FIG. 5 illustrates an embodiment of a circuit board 500 that includes two instances of planar inverted-f antennas. Such a circuit board 500 may be, for example, part of a multi-part HVAC control system comprising a thermostat head unit. The thermostat head unit may be power-constrained. In wireless communication with the thermostat head unit may be a base unit that contains circuitry activating heat-generating and cool-generating components that needs wireless connectivity to the thermostat head unit. Typically, the base unit, in which circuit board 500 may be present, may be mounted to a metallic surface. Such a metallic surface may cause interference for at least some forms of antennas. While FIG. 5 illustrates a circuit that may be present in a base unit for communicating with a thermostat head unit, the features and advantages of the embodiments detailed herein can readily be applied in the context of a variety of wireless devices, such as smart-home devices, including life safety devices such as smoke detectors and carbon monoxide detectors, other implementations of thermostats (e.g., thermostats that communicate with other forms of devices), smart lights, home security systems, appliances, and/or other forms of devices for which reliable wireless communications is useful.

PIFA 510-1 and PIFA 510-2 are mounted to PCB 520 of circuit board 500. PIFAs 510 are mounted to PCB 520 in a perpendicular or approximately perpendicular pattern, which may improve radiation and/or reception characteristics. PCB 520 represents a circuit board configured to function as part of a thermostat, smoke detection system, and/or carbon monoxide detection system. It should be understood that such an embodiment is merely exemplary. As an example, one or more of PIFAs 510 may be used for communicating using IEEE 802.15.4 or some other wireless communication protocol (which could include low-rate wireless personal area networks). Specifically, one or both of PIFAs 510 could be used for communicating via a ZigBee® or some other low-rate in-home wireless communication protocol. Additional detail may be found in U.S. patent application Ser. No. 14/229,651 filed on Mar. 28, 2014, which is hereby incorporated by reference for all purposes.

Figure 6:
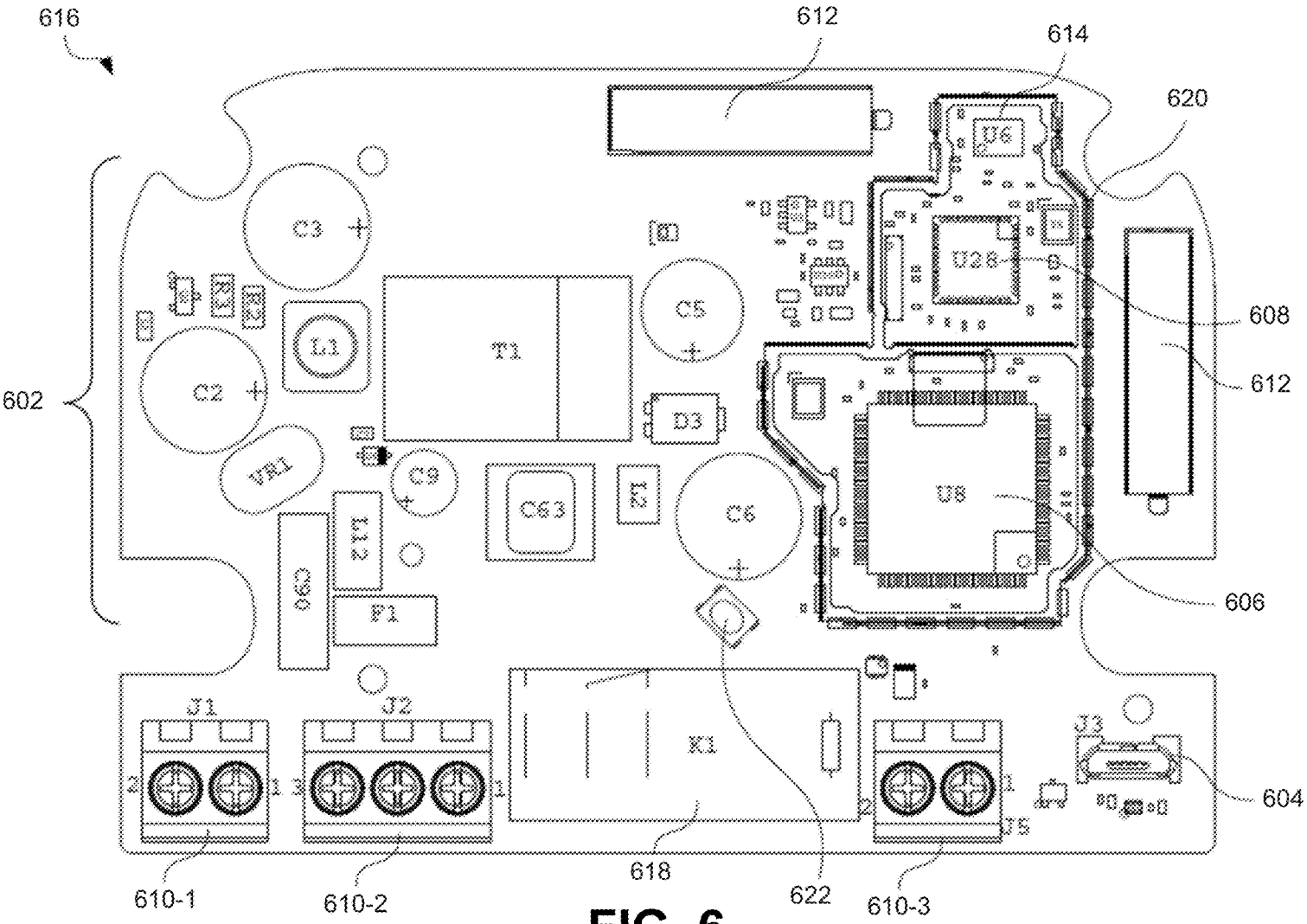
FIG. 6 illustrates an embodiment of a layout of a circuit board having two mounted instances of stabilized planar inverted-f antennas.

As an exemplary use of PIFAs 100, a circuit board layout is presented that uses two PIFAs. It should be understood that other embodiments may have one or more than two PIFAs. FIG. 6 illustrates an embodiment of a base unit circuit board 616 having two mounted instances of planar inverted-f antennas. Base unit circuit board 616 may represent circuit board 500 of FIG. 5. Base unit circuit board 616 may receive 220 VAC power from the main power line of the enclosure. Wire connector 610-1 may receive the "N" and "L" wires from the main power line. Wire connector 610-3 may receive the two-wire connection to the intelligent thermostat, if available. Wire connector 610-2 may receive the satisfied, common, and call-for-heat wires that are connected to the boiler or zone controllers. Wire connectors 610 may be configured such that they may receive physical wires that can be secured by a screw-down (or other) clamping mechanism.

Figure 7:
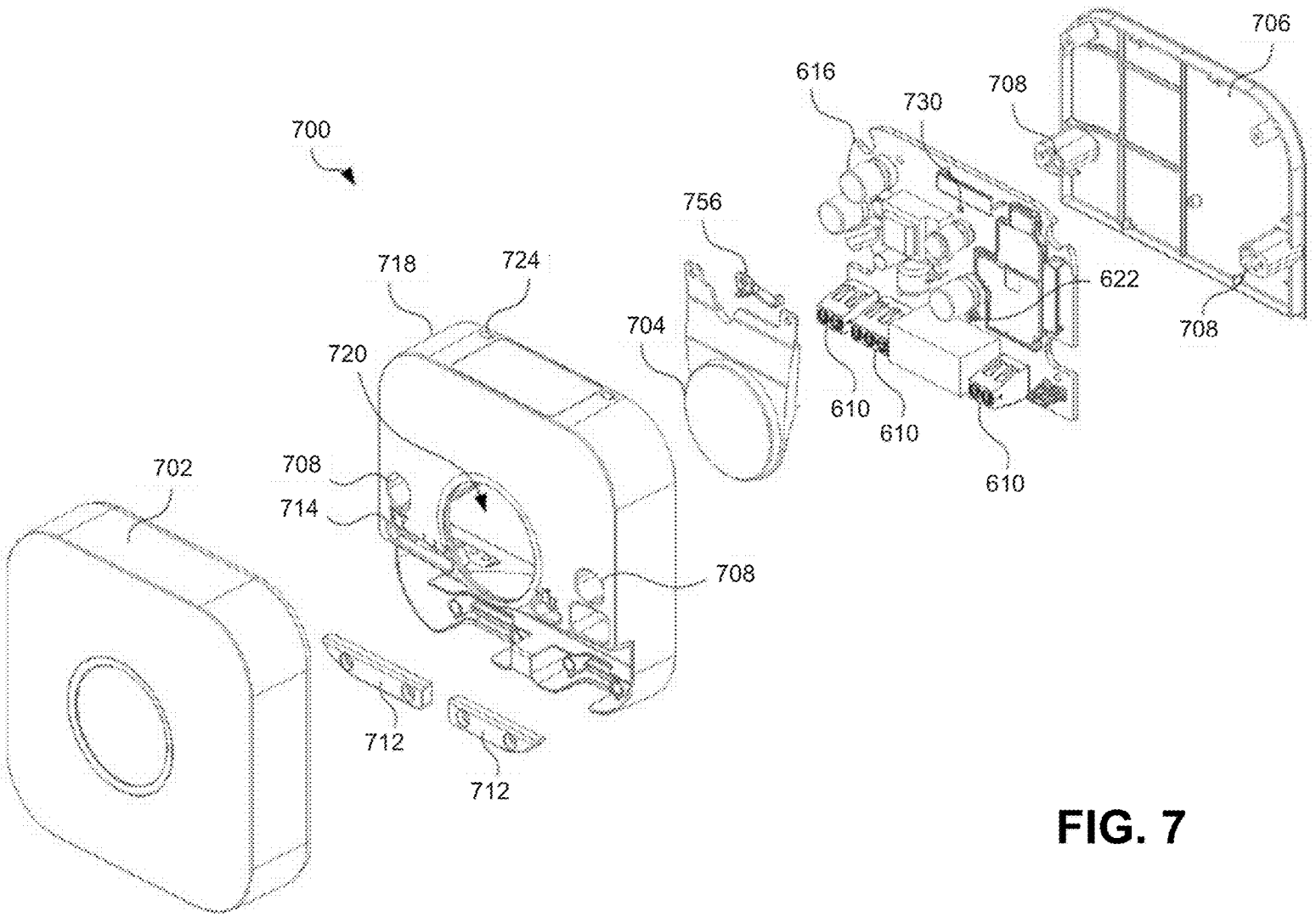
FIG. 7 illustrates an embodiment of an HVAC control module having two mounted instances of stabilized planar inverted-f antennas.

The base unit circuit board 616 may also include a button 622 that can interface with a button 604 accessible through the front cover 602 (detailed in FIG. 7). For example, the button 604 may be a 4.2 mm×3.2 mm×2.5 mm tactile switch available from Alps® (SKRPABE010). The base unit circuit board 616 may also include a power regulation circuit 602 that is configured to take the 220 VAC line power input and convert it to DC voltage levels. In this embodiment, a flyback converter may be a suitable converter type for these power levels, although other suitable converters may alternatively be used. As will be understood by one having skill in the art, a flyback converter includes a first phase that charges up a storage element and a second phase that converts power from the storage element into a regulated DC voltage. Many different flyback converter designs are possible. One particular flyback converter design implemented in an embodiment uses a transformer (T1), multiple inductors (L1, L2, L12, etc.) for filtering and emissions reduction, multiple storage capacitors (C2, C3, C5, C6, etc.), and a high-performance AC/DC controller designed to drive an external power bipolar junction transistor (BJT) for peak mode flyback power supplies, such as the iW1707 digital controller available from iWatt®. Additionally, the power regulation circuit 602 may include DC conversion circuits and filtering circuits configured to provide the DC voltage for the wired connection to the intelligent thermostat through the wire connectors 610-3 as well as power for the base unit microcontroller and radio. This may include a 4.4 V converter, a 1.8 V buck converter (e.g., TPS62170 available from Texas Instruments®), one or more single slew rate controlled load switches (e.g., AP 2281 from Diodes Inc.®), a 6LoWPAN Pi Filter, and a 6LoWPAN FEM load switch. The base unit circuit board 616 may also include a USB connector 604 (e.g., Molex 105133-0031). The USB connector 604 can be used to program the base unit processor/microcontroller 606 and/or base unit radio 608, and power the associated circuitry during such programming.

The base unit processor/microcontroller 606 may be any available microcontroller or microprocessor. For example, in this embodiment, the base unit processor/microcontroller 606 uses a 32-bit microcontroller based on the ARM Cortex-M4 core which includes high-speed USB 2.0, flash memory, and integrated ADC, such as the Kinetis K60 family of microcontrollers from Freescale Semiconductor. The base unit processor/microcontroller 2206 may be programmed through a JTAG/UART debug ZIF connector. Additionally, the base unit circuit board 616 may include a radio 608 in order to establish wireless communications with the radio in the head unit of the intelligent thermostat. For example, the base unit circuit board 616 may include a wireless integrated 802.15.4 compatible radio, such as the EM357 chip available from Silicon Labs®. The radio 608 may operate in conjunction with a wireless front end module 614, such as the SE2432L RF front end module by Skyworks®. In order to isolate the digital noise from the base unit processor/microcontroller 606, and to isolate RF noise generated by the radio 608 and front end module 614, the base unit circuit board 616 may include metal shielding 620 around each of these components. The base unit may also include one or more temperature sensor, which may comprise a discrete thermistor, a thermocouple, and/or an integrated circuit. The temperature sensor(s) may or may not include an integrated humidity sensor. The temperature sensor(s) may be integrated into a microcontroller or radio IC. A temperature measured by the temperature sensor(s) may be reported back to the head unit periodically and/or upon the occurrence of an anomalous condition.

The radio communications may operate using an IEEE 802.15.4 protocol compliant communication scheme. In some embodiments, the ZigBee standard, which is built on top of the IEEE 802.15.4 protocol, may be used in communication. In one embodiment, a proprietary communication scheme may be used that is built on top of the IEEE 802.15.4 protocol yet avoids the ZigBee-specific features. For example, the "Thread" protocol developed by Nest Labs, Inc., of Palo Alto, Calif. may be used for wireless communication between the base unit and the intelligent thermostat as described in U.S. Ser. No. 13/926,312 (Ref. No. NES0310-US), supra. This particular communication protocol requires that the radio 608 in the base unit be paired with the radio in the intelligent thermostat. This pairing may be done before the intelligent thermostat system is sold to a consumer. The pairing may also be done after installation, using an electronic device interface such as a smart phone interface, the button 604 on the backplate, and/or any of the USB terminals on the intelligent thermostat or base unit. In some embodiments, a mixed protocol may be used that utilizes the "Thread" communication scheme but also operates as a mixed protocol where paired devices can also communicate with a larger network of smart home devices.

The base unit circuit board 616 also includes a pair of PIFAs 612. These antennas may represent embodiments of PIFA 100, as detailed in this document. In this embodiment, the PIFAs 612 are made of a raised, stamped metal that sits above the base unit circuit board 616. It has been discovered by the inventors that mounting the base unit 700 directly to a boiler often involves mounting the base unit 700 to a large piece of sheet metal. The sheet metal of the boiler often causes interference with antenna reception. Therefore, PIFAs 612 were raised off the circuit board in order to prevent this type of interference and improve the radiation pattern. Note that PIFAs 612 are oriented with one 90° rotated from the other. If one of the PIFAs 612 does not receive a signal clearly, the other of the PIFAs 612 should have better reception based on this antenna orientation. The base unit circuit board 616 may include a large ground plane within a layer of the base unit circuit board 616 located behind the PIFAs 612 in order to increase their performance.

In order to interface with the boiler system or some other system with which the system is in communication, a relatively large relay circuit is used to make connections between the satisfied, common, and call-for-heat wire connections. A power PCB relay 618, such as the RTB7D012 available from Tyco Electronics® can be used in conjunction with an inductive load driver, such as the NUD3124 from On Semiconductor® to selectively make connections between these wire connections. The power PCB relay 618 may operate with the regulated 12 VDC output from the flyback converter.

Also, one or more sensors, such as smoke or carbon monoxide, that depend on airflow may be incorporated on base unit circuit board 616. Such sensors may require airflow over base unit circuit board 616. Therefore, it may be beneficial to have PIFAs 612 not extend too high above base unit circuit board 616.

FIG. 7 illustrates an embodiment of an HVAC control module having two mounted instances of planar inverted-f antennas. FIG. 7 illustrates an exploded front perspective view of a base unit 700 of an intelligent thermostat system, according to some embodiments in which base unit circuit board 616 is present. In this embodiment, the base unit 700 may be comprised of the front cover 702, the back cover 706, a body 718, the button 704, and a base unit circuit board 616. Like the front cover 702, the body 718 may be constructed using a molded plastic that exposes an interface for connecting wires to/from the boiler system as well as wires to/from the intelligent thermostat. The wires may enter through gaps in the bottom of the front cover 702 and the body 718 and may be held in place by screw-down clamps 712 to prevent wire slippage or accidental disconnection. The body 718 may also include cutouts through which the wires may be inserted as well as cutouts 714 through which a user can secure the wires, using a screwdriver into the wire connectors 610 on the base unit circuit board 616. The body 718 may include labels for each of the terminals. The labels may be printed, etched, and/or integrated into the body of the molded plastic. The body 718 may also include recesses through which the screw holes 708 may be accessed. As will be apparent in FIG. 7, the entirety of the base unit may be assembled with the exception of the front cover 702. This assembly can be mounted to a surface through the screw holes 708, after which the front cover 702 can be secured to the rest of the base unit 700.

The button 704 may be accessible through a recess 720 in the body 718 of the base unit 700. Next to the button 704, a light pipe 756 may direct light from an LED 730 such that light emitted from the LED is visible through the front cover 702. The button 704 may also be mechanically adjacent to a corresponding button 622 on the base unit circuit board 616 such that depressing the button 704 actuates the button 622 on the base unit circuit board 616. The base unit circuit board 616 may include circuitry for switching and/or connecting HVAC functions associated with the boiler system, processor circuitry, wireless and wired communications circuitry, and wire connectors 610. The base unit circuit board 616 will be described in greater detail below. The base unit circuit board 616 can be secured to the back cover 706 through screw holes in the base unit circuit board 616, and the body 718 and button 704 can be secured to the back cover 706. As described above, the front cover 702 can be secured to the body 718, using a combination of the tabs 724 at the top of the body 718 and a screw mechanism (not visible) at the bottom of the body 718.

Due to front cover 702 and body 718, it may be useful to not have PIFAs 612 extend far above the PCB. For instance, airflow within base unit 700 may be desired to be maximized and/or space may be desired to be saved to decrease the depth needed for front cover 702 and body 718.

Figure 8:
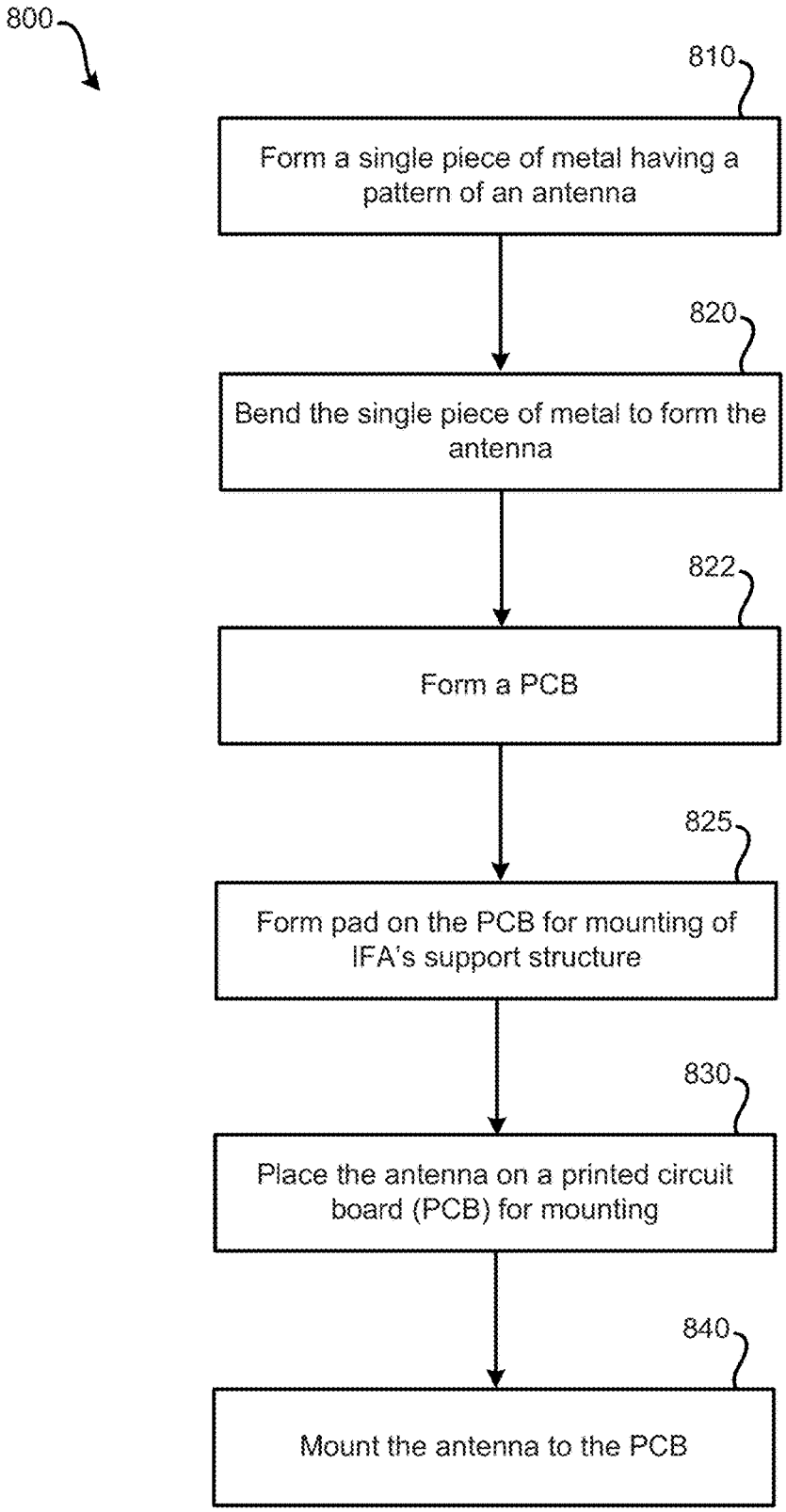
FIG. 8 illustrates an embodiment of a method for creating and mounting a stabilized planar inverted-f antenna.

One or more PIFAs, such as those detailed in relation to FIGS. 1-4 and/or those incorporated in the circuits detailed in FIGS. 4-7, may be used as part of a method for manufacturing a circuit. FIG. 8 illustrates an embodiment of a method 800 for creating and mounting a stabilized planar inverted-f antenna on a PCB as part of a circuit.

At step 810, a single piece of metal may be formed (e.g., cut, poured, or otherwise created) that represents a two-dimensional (not accounting for the thickness of the metal) pattern of the PIFA. From this formed piece of metal, the PIFA may be created by bending (or, more generally, by creating) the two-dimensional pattern to create the three-dimensional PIFA at step 820. As such, the PIFA may be created from a single piece of metal. In other embodiments, the PIFA may be formed from several pieces of metal (or some other form of conductive material, or in some embodiments, non-conducive material for certain portions such as support structure 140 and foot 142). Multiple purposefully bent PIFAs may be placed on trays for use by a pick-and-place machine in manufacturing a circuit on a PCB.

At step 822, a PCB may be formed. On this PCB, the PIFA may be eventually mounted. The PCB may be formed with one or more various keep-out regions, metallic pads, and traces. For instance, a keep-out region may be maintained around the mounting location for a surface-mount foot of a support structure of the PIFA. Keep-out regions may also be created for the feed structure, ground shorting structure, or both. Keep-out regions may be created during the manufacture of the PCB as previously detailed in relation to FIG. 3A.

At step 825, a pad may be formed on the surface of the PCB to which the support structure of the PIFA is to be mounted. The pad may be a metallic pad configured in size and location to have the support structure and, possibly, a support foot mounted to it. Covering at least a portion of the edge of the metallic pad on the PCB, solder mask (resist) may be adhered to the PCB and the metallic pad. An exemplary arrangement is presented in FIG. 3B. This application of solder mask over a portion of the metallic pad may strengthen the attachment of the metallic pad to the PCB. After the support structure of the PIFA is mounted to the metallic pad, the PIFA may be additionally stable due to how the metallic pad is bonded with the PCB with the solder mask partially overlapping the metallic pad.

At step 830, the PIFA may be placed at the appropriate location on the PCB for mounting. The PIFA may be placed by a pick-and-place machine. This may involve the pick-and-place machine using suction (or some other grabbing means) to pick up the PIFA, move it to the appropriate location on the PCB, and push it into place. While being pushed into place, the support structure and/or longitudinal support elements of the PIFA may help protect the PIFA from being bent and/or may help the PIFA be aligned in the correct orientation. Solder paste may be used to initially hold the PIFA to the PCB once pushed into place. Once pressed into the appropriate location on the PCB, the suction may be removed and the pick-and-place machine may release the PIFA.

At step 840, the PIFA may be mounted to the PCB, using solder or some other attachment means such as glue. For example, heat may be used to flow the solder paste or the solder paste may be workable for a period of time before drying. Solder may be used to form electrical connections between a signal source (or receiver) on the PCB and the feed structure and also an electrical connection between the ground shorting structure and ground (possibly including the ground plane) on the PCB. The supporting structure may remain isolated on the PCB, but may have an electrical connection to the signal source (or receiver) and/or the ground shorting structure via the PIFA's upper arm.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

While various measurements are noted in some of the previously-described embodiments, it should be understood that these measurements are examples only. Generally, the dimensions of the antenna are derived based on the desired operating frequency range. The dimensions are adjusted to account for various factors, such as dielectric material, surrounding environment, etc.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Furthermore, examples of the methods may be implemented by hardware, software, firmware, middleware, microcode, hardware description languages, or any combination thereof. When implemented in software, firmware, middleware, or microcode, the program code or code segments to perform the necessary tasks may be stored in a non-transitory computer-readable medium such as a storage medium. Processors may perform the described tasks.

Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. An antenna of an electronic device, comprising:

an upper arm having a length, being arranged substantially parallel to a ground plane, and being mechanically and electrically coupled to a ground shorting structure, a support structure, and a feed structure;

the ground shorting structure being configured to electrically couple the upper arm to the ground plane, being arranged at a first end of the length of the upper arm and extending from the upper arm to a direction perpendicular to the upper arm;

the support structure being configured to be mechanically coupled to a circuit board, being arranged at a second end of the length of the upper arm opposite the first end, and extending from the upper arm in a direction perpendicular to the upper arm;

the feed structure being mechanically coupled to a side of the upper arm that is perpendicular to the first end and the second end, and extending from the upper arm in a direction perpendicular to the upper arm; and a first longitudinal support structure that is substantially perpendicular to the upper arm, the first longitudinal support structure extending along the length of the upper arm starting from the second end and ending at the feed structure, wherein the first longitudinal support structure and the upper arm are formed from a single piece of conductive material.

2. The antenna of claim 1, wherein the ground shorting structure comprises a through-hole portion, the feed structure comprises a through-hole portion such that the antenna is configured to be surface mounted to the circuit board.

3. The antenna of claim 1, wherein the support structure comprises a foot for surface mounting to a surface of the circuit board.

4. The antenna of claim 1, wherein the antenna is a planar inverted-f antenna.

5. The antenna of claim 1, the antenna further comprising a second longitudinal support structure, wherein the second longitudinal support structure extends along the length of the upper arm between the first end and the second end.

6. The antenna of claim 1, wherein the upper arm is configured to decrease interference with airflow over a surface of the upper arm farthest from the ground plane.

7. The antenna of claim 1, wherein the upper arm, the ground shorting structure, the support structure, and the feed structure are a single piece of metal folded to form the antenna.

8. The antenna of claim 1, wherein the ground shorting structure is configured to be electrically coupled to a layer of the circuit board farthest from the upper arm, wherein at least a portion of the layer serves as the ground plane.

9. The antenna of claim 1, wherein the feed structure and the ground shorting structure are configured to be through-hole mounted to the circuit board.

10. The antenna of claim 1, wherein the upper arm has a width that is at least twice as wide as a width of the support structure.

11. A method for forming an antenna, the method comprising:

folding a first portion of a conductive material to create an upper arm having a length, being arranged substantially parallel to a ground plane, and being mechanically and electrically coupled to a ground shorting structure, a support structure, and a feed structure;

folding a second portion of the conductive material to create the ground shorting structure being configured to electrically couple the upper arm to the ground plane, being arranged at a first end of the length of the upper arm and extending from the upper arm to a direction perpendicular to the upper arm;

folding a third portion of the conductive material to create the support structure being configured to be mechanically coupled to a circuit board, being arranged at a second end of the length of the upper arm opposite the first end, and extending from the upper arm in a direction perpendicular to the upper arm;

folding a fourth portion of the conductive material to create the feed structure that is mechanically coupled to a side of the upper arm that is perpendicular to the first end and the second end, and extending from the upper arm in a direction perpendicular to the upper arm; and folding a fifth portion of the conductive material to create a first longitudinal support structure that extends along the length of the upper arm starting at the second end and ending at the feed structure, is substantially perpendicular to the upper arm, and is distinct from the ground shorting structure, support structure, and feed structure.

12. The method for forming the antenna of claim 11, further comprising: mounting the antenna to the circuit board via a surface mount process.

13. The method for forming the antenna of claim 12, wherein mounting the antenna to the circuit board comprises electrically coupling a layer of the circuit board farthest from the upper arm with the ground shorting structure, wherein at least a portion of the layer serves as the ground plane.

14. The method for forming the antenna of claim 11, wherein creating the support structure comprises configuring the support structure to be surface mounted to a surface of the circuit board proximate to the upper arm.

15. The method for forming the antenna of claim 11, wherein creating the upper arm comprises configuring a height of the upper arm to decrease interference with airflow over the surface of the upper arm farthest from the ground plane.

16. The method for forming the antenna of claim 11, wherein creating the feed structure and the ground shorting structure comprises configuring the feed structure and the ground shorting structure to be through-hole mounted to the circuit board.

17. The method for forming the antenna of claim 11, further comprising:

forming a metallic mounting pad on the circuit board for the support structure;

covering the entire surface edge of the metallic mounting pad with a solder mask, leaving a portion of the metallic mounting pad exposed; and attaching the support structure to the portion of the metallic mounting pad exposed from the solder mask.

18. An electronic device, comprising:

an antenna, comprising:

an upper arm having a length, being arranged substantially parallel to a ground plane, and being mechanically and electrically coupled to a ground shorting structure, a support structure, and a feed structure;

the ground shorting structure being configured to electrically couple the upper arm to the ground plane, and being arranged at a first end of the length of the upper arm;

the support structure being configured to be mechanically coupled to a circuit board, and being arranged at a second end of the length of the upper arm opposite the first end;

the feed structure mechanically coupled to a side of the upper arm that is perpendicular to the first end and the second end, and extending from the upper arm in a direction perpendicular to the upper arm; and a longitudinal support structure that is substantially perpendicular to the upper arm, the longitudinal support structure extending along the upper arm starting at the second end and ending at the feed structure, wherein the longitudinal support structure and the upper arm are formed from a single piece of conductive material; and a printed circuit board (PCB) on which the antenna is mounted, the PCB comprising:

a plurality of layers; and a keep-out region that excludes ground and signal traces around the support structure from the plurality of layers of the PCB.

19. The electronic device of claim 18, wherein the ground plane is part of a layer of the plurality of layers of the PCB.

20. The electronic device of claim 19, wherein the antenna is mounted to the top of the PCB and the ground plane is part of a lowest layer of the plurality of layers of the PCB.

21. The electronic device of claim 19, wherein the antenna is mounted to the top of the PCB and the ground plane is part of all of the plurality of layers of the PCB.

22. The electronic device of claim 19, wherein the antenna is mounted to the top of the PCB and the ground plane is the top layer of the PCB.

23. The electronic device of claim 18, wherein the ground plane is separate from the PCB.

24. The electronic device of claim 18, wherein the PCB further comprises:

a metallic mounting pad for the support structure, wherein the metallic mounting pad comprises:

a metallic pad to mount the support structure to the circuit board; and solder mask that overlaps the entire surface edge of the metallic pad on the PCB.

25. The electronic device of claim 18, further comprising:

a second keep-out region that excludes ground and signal traces around the feed structure from the plurality of layers of the PCB.

* * * * *